US007849810B2

(12) United States Patent
Cline et al.

(10) Patent No.: US 7,849,810 B2
(45) Date of Patent: Dec. 14, 2010

(54) MATING OF BUOYANT HULL STRUCTURE WITH TRUSS STRUCTURE

(75) Inventors: Bobby P. Cline, Morgan City, LA (US); Jack Darryl Payne, Spring, TX (US); Yun Ding, Sugar Land, TX (US)

(73) Assignee: J. Ray McDermott, S.A., Houston, TX (US)

( * ) Notice: Subject to any disclaimer, the term of this patent is extended or adjusted under 35 U.S.C. 154(b) by 41 days.

(21) Appl. No.: 12/429,229

(22) Filed: Apr. 24, 2009

(65) Prior Publication Data

US 2010/0269746 A1 Oct. 28, 2010

(51) Int. Cl.
*B63B 35/44* (2006.01)

(52) U.S. Cl. ..... 114/264; 405/204; 405/209

(58) Field of Classification Search ..... 114/264, 114/266, 267; 405/195.1, 205, 223.1, 203, 405/204, 206, 207, 208, 209, 224
See application file for complete search history.

(56) References Cited

U.S. PATENT DOCUMENTS 3,572,041 A * 3/1971 Graaf ..... 405/205
6,135,673 A * 10/2000 Horton et al. ..... 405/205
6,340,272 B1 * 1/2002 Runge et al. ..... 114/264
6,354,765 B2 * 3/2002 Jones ..... 405/203
6,511,261 B2 * 1/2003 de Waard et al. ..... 405/204
6,565,286 B2 * 5/2003 Carr et al. ..... 405/205
6,968,797 B2 * 11/2005 Persson ..... 114/264
7,011,473 B2 * 3/2006 Tangen et al. ..... 405/209

* cited by examiner

*Primary Examiner*—Lars A Olson
(74) *Attorney, Agent, or Firm*—D. Neil LaHaye

(57) ABSTRACT

A method of mating of a buoyant hull with a truss structure while at the installation site of the completed offshore structure. The buoyant hull is moored in place. The truss structure is placed in the water, self upends, and maneuvered near the buoyant hull. The buoyant hull and truss structure are rigged with lines to allow the truss structure to be pulled into engagement with the buoyant hull. The truss structure is lowered to a predetermined depth below the water surface but above the sea floor and the weight is transferred to the lines from the buoyant hull. The truss structure is aligned with the buoyant hull and lines from the buoyant hull are used to pull the truss structure into engagement with the buoyant hull. The truss structure and buoyant hull are rigidly attached together as is customary using grouting and welding.

8 Claims, 13 Drawing Sheets

MATING OF BUOYANT HULL STRUCTURE WITH TRUSS STRUCTURE

FIELD AND BACKGROUND OF INVENTION

The invention is generally related to the construction and assembly of floating offshore structures and more particularly to the construction and assembly of a buoyant hull and a truss frame.

Unlike ships which can be fully assembled at an inshore facility, many types of oil drilling and production facilities for the offshore oil production industry require part of the assembly to take place either at the field location itself or at another offshore site prior to the tow to the field location. Spar type structures and, more recently, some semi-submersible designs fall into this category.

Due to the deep draft of spar type structures, the traditional construction sequence involves joining the structural sections of the hull in the horizontal position, transporting the completed hull in the horizontal position, followed by upending of the entire spar structure to the vertical position at a site with sufficiently deep water to accommodate the deep draft.

The structural section may consist of either plated hull tank sections only or a combination of plated tank and truss type sections. Such spar type platforms are described in U.S. Pat. Nos. 4,702,321 and 5,558,467.

As a consequence of horizontal assembly and transport of the spar structure followed by an upending sequence, numerous restrictions come into play that complicate and limit the size of the hull that can be constructed. This can result, depending on geographical location, in any or all of the following:

Draft of the assembled hull in a horizontal orientation exceeds the dredged depths in inland navigable channels for wet tow to the offshore site.

Draft of hard tank or truss sections in horizontal orientation exceeds water depths in inshore assembly areas, dry dock sill clearance depths, and/or heavy lift vessel maximum deck submergence depths. The draft restrictions imposed by fabrication facilities and transportation equipment limit the size of hulls that can be constructed.

Size and weight of hull in horizontal orientation exceeds the hydrodynamic stability and strength capabilities of the largest existing heavy lift transport vessels. This dictates transportation in sections for final horizontal assembly in an erection facility an acceptably short distance from the offshore site.

U.S. Pat. No. 6,565,286 to Carr, et al. addresses the joining of the buoyant hull and truss frame by having the operation carried out in relatively shallow water. The truss section is lowered in a vertical position such that it sits on the sea floor. The buoyant hull is then positioned above the truss section. Lines from winches on the buoyant hull are attached to the truss section. The winches and lines are then used to pull the truss section into engagement with the buoyant hull. The attachment between the buoyant hull and truss section is made rigid by welding and/or grouting. The combined hull and truss section are then towed to the installation site. This operation is commonly referred to as grounded mating.

The configuration of the hard tank in Carr, et al. above is such that the diameter is very large and the depth (or height) is very shallow so that the hard tank is not suitable to be in a horizontal orientation in the water for stability reasons.

For the grounded mating option, geotechnical/geological risks come from both the mating site as well as the installation/platform site. Weather risks also come from both the mating site and the installation /platform site. While weather related risks can be somewhat mitigated, finding an appropriate mating site for the grounded mating option could result in increased towing distances/exposure times for mobilizing to/demobilizing from the mating site and mobilizing to the installation site. Further, the mated integrated truss semi-submersible structure will have to be temporarily stowed at a safe location while piles and mooring system installation are done at the installation site.

In recent years, there have been a number of semi-submersible designs incorporating the use of open truss frames in an attempt to combine the advantages of the semi-submersible, which has a shallower draft than a spar type structure, with the advantages of an open truss frame having heave plates for reducing the heave natural period of the structure. Before the open truss frame is assembled on the hull, the hull is typically integrated with the topsides already and therefore must be in a vertical position during the assembling of the open truss frame on to the hull.

One design (U.S. Pat. No. 6,637,979 to Finn, et al.) has addressed the issue by modifying the typical semi-submersible structure to include a telescoping open truss frame. This design presents a number of difficulties such as modification of the entire semi-submersible structure to accommodate the telescoping section and lack of ready adaptability for different size truss frames.

SUMMARY OF INVENTION

The present invention is drawn to the mating of a buoyant hull with a truss structure while at the installation site of the completed offshore structure. The buoyant hull is moored in place. The truss structure is placed in the water near the buoyant hull, self upends, and maneuvered near the buoyant hull. The buoyant hull and truss structure are rigged with lines to allow the truss structure to be pulled into engagement with the buoyant hull. The truss structure is lowered to a predetermined depth below the water surface but above the sea floor and the weight is transferred to the lines from the buoyant hull. The truss structure is aligned with the buoyant hull and lines from the buoyant hull are used to pull the truss structure into engagement with the buoyant hull. The truss structure and buoyant hull are rigidly attached together as is customary using grouting and welding.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

It should be understood that, while the drawings illustrate the buoyant hull section as a semi-submersible structure, the invention is applicable to other structures such as a spar hull with a truss structure.

Figure 1:
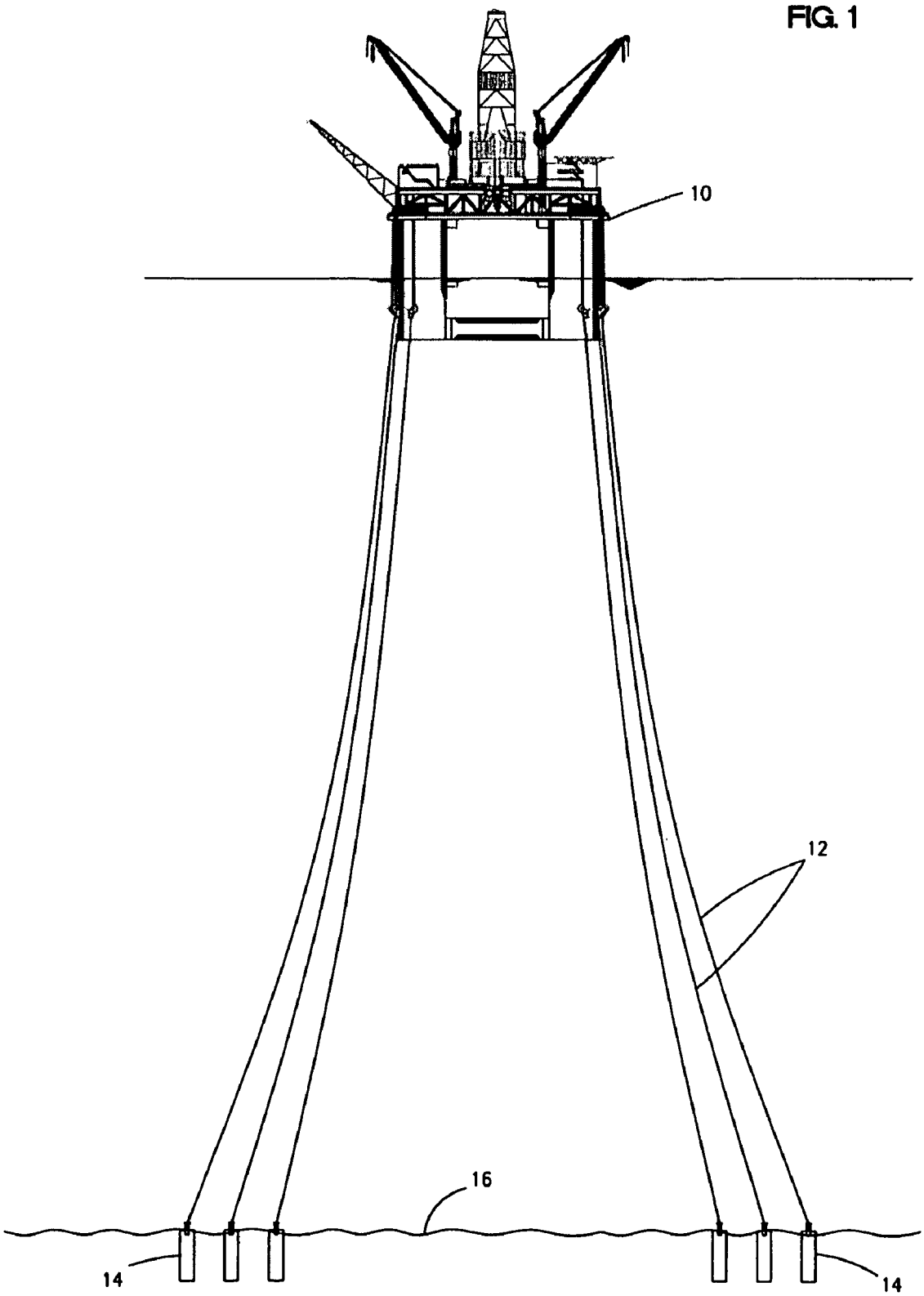
FIG. 1-8 illustrate the steps of the invention.

As seen in FIG. 1, the buoyant hull 10 is moored in place using mooring lines 12 attached to anchors or piles 14 installed in the sea floor 16. The buoyant hull 10 is positioned at a suitable draft for the connection operation with the truss section. The procedures for towing a buoyant hull and installing mooring lines are well known in the offshore industry.

Figure 2:
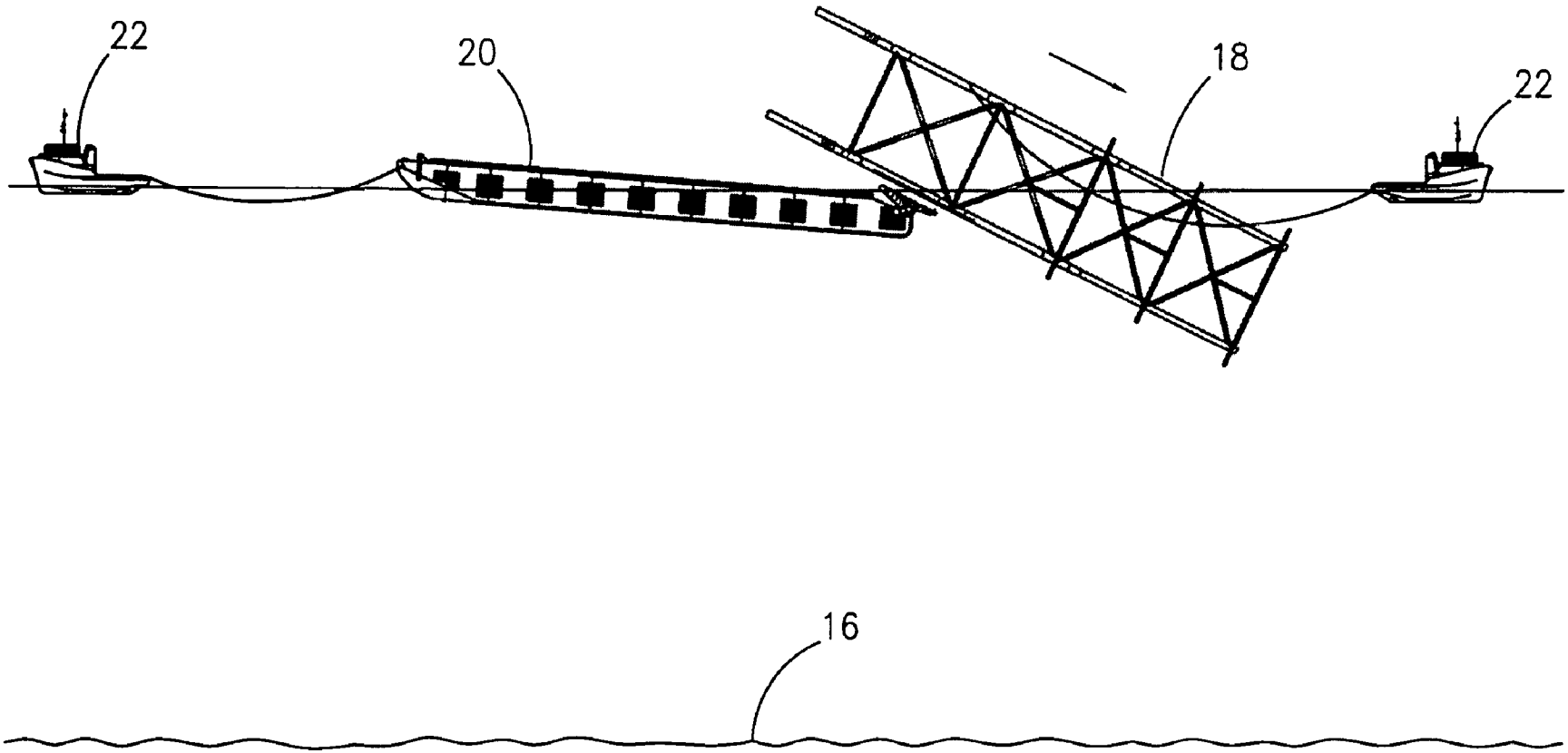

As seen in FIG. 2, the truss structure 18 is transported to the site on a barge 20 that is pulled by tugboats 22. The barge 20 has the capability of launching a structure such as the truss structure 18 into the water and is well known in the offshore industry.

Figure 3:
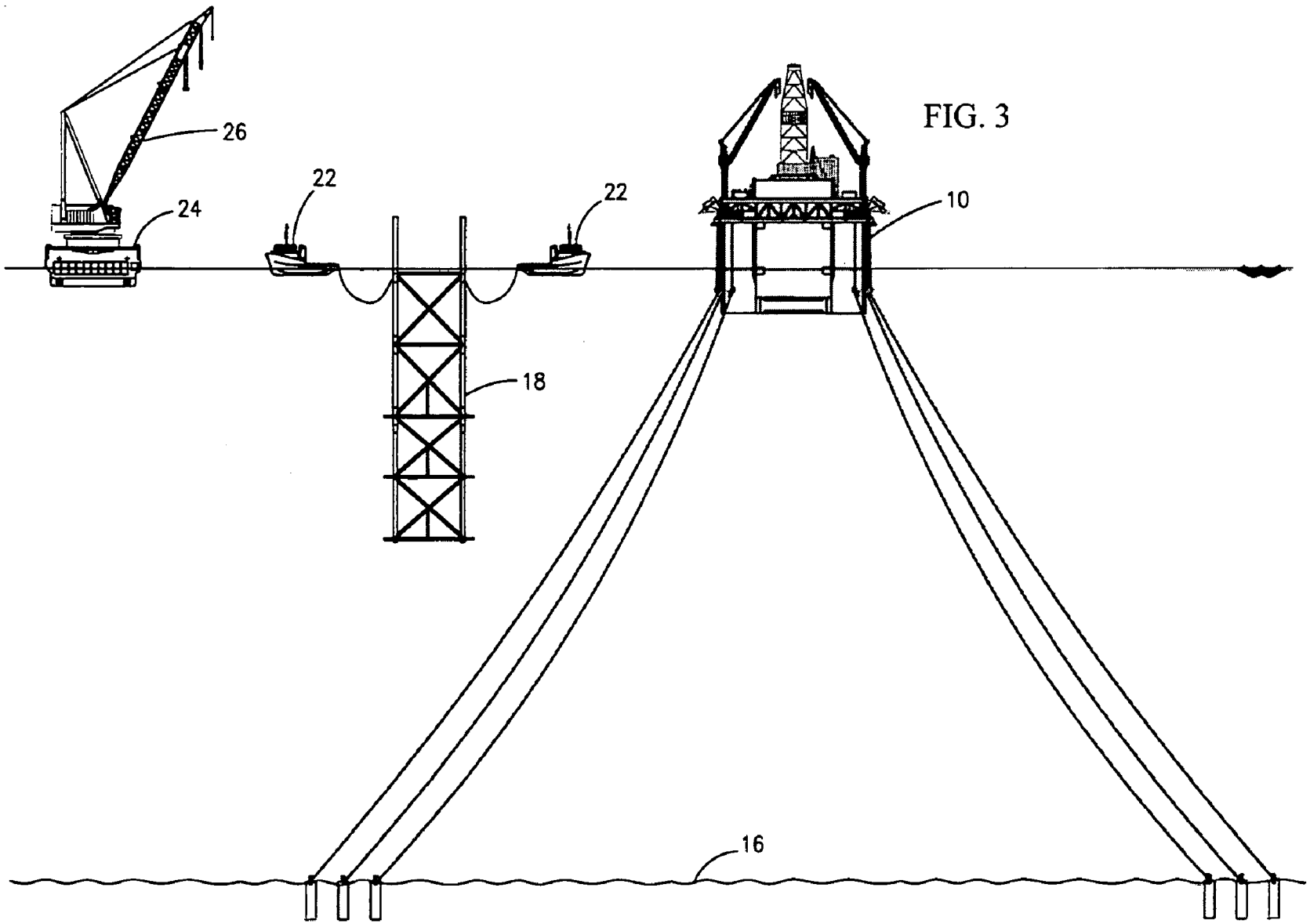

As seen in FIG. 3, the truss structure 18 is self upended to a position that is essentially vertical in the water in preparation for attachment to the buoyant hull 10. The shape and buoyancy of the truss section 18 help place it in this orientation.

Figure 4:
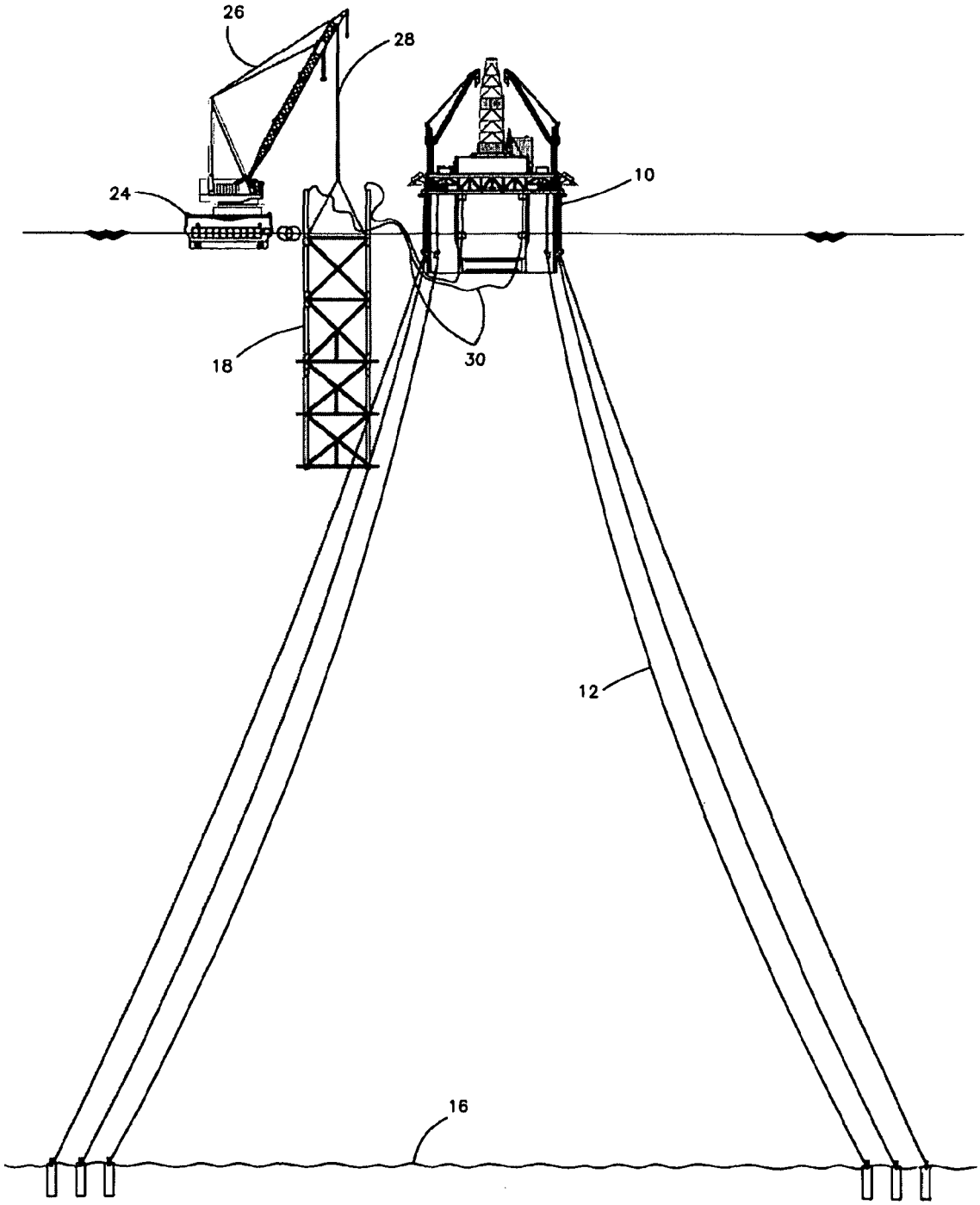

As seen in FIG. 4, the tug boats 22 are used to position the truss structure 18 near the buoyant hull 10. A work vessel 24 with a crane 26 is moved next to the truss structure 18. Crane support lines 28 and haul-in lines 30 are attached to the truss structure 18. The haul-in lines 30 are attached to the truss structure 18 at one end and at the opposite end to winches not readily seen in the drawings on the buoyant hull 10.

Figure 5:
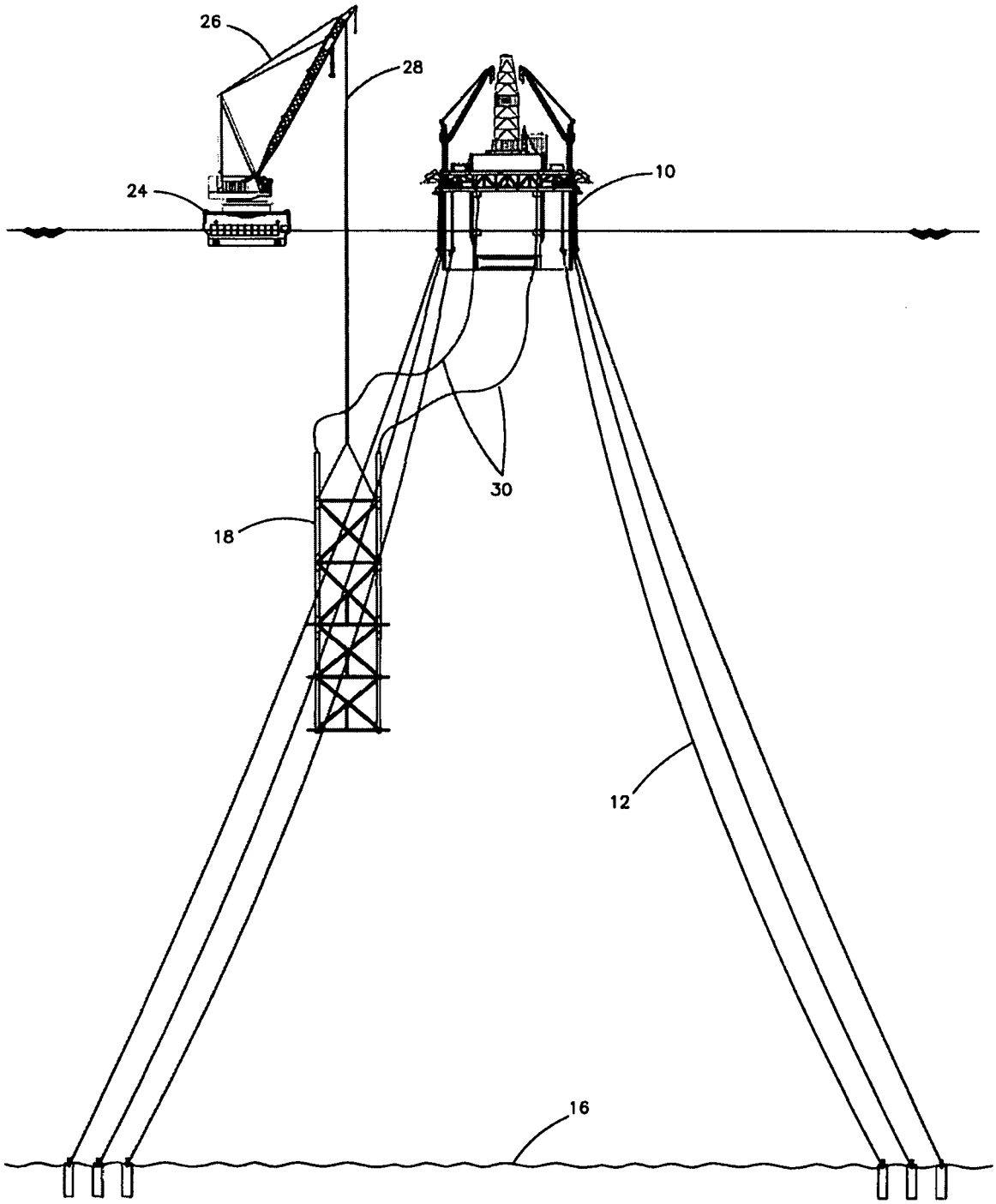
Figure 6:
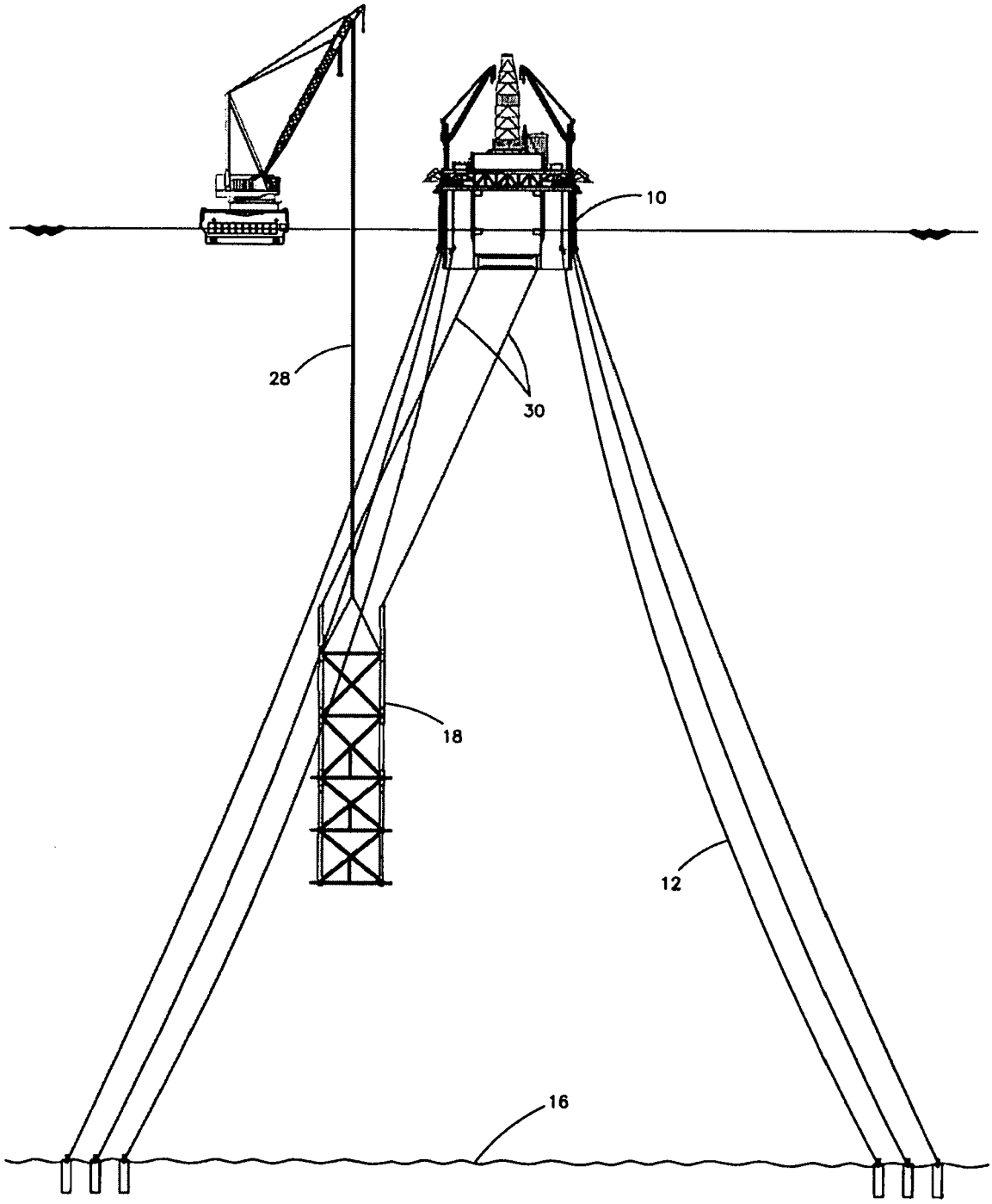
Figure 7:
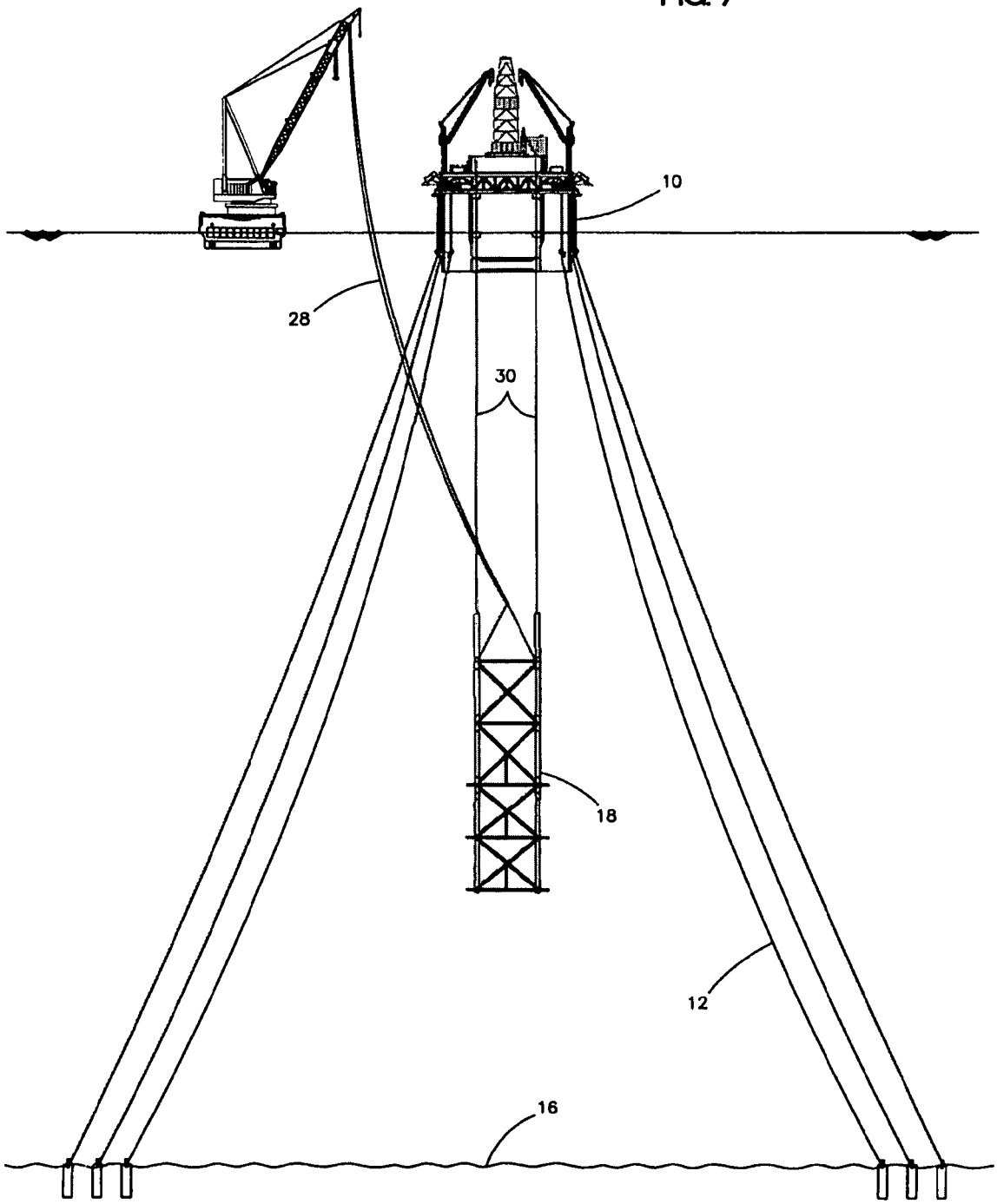
Figure 8:
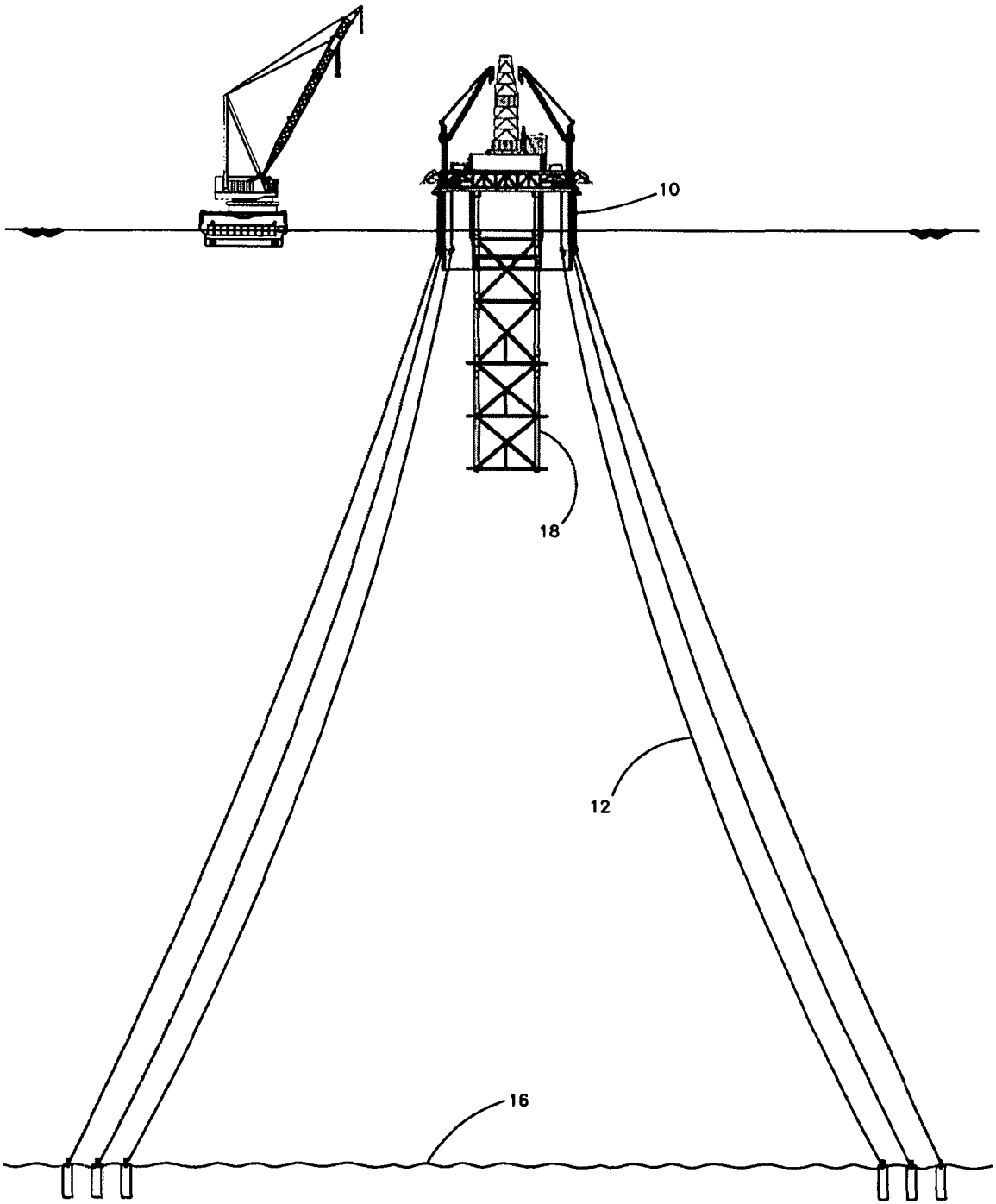
Figure 9:
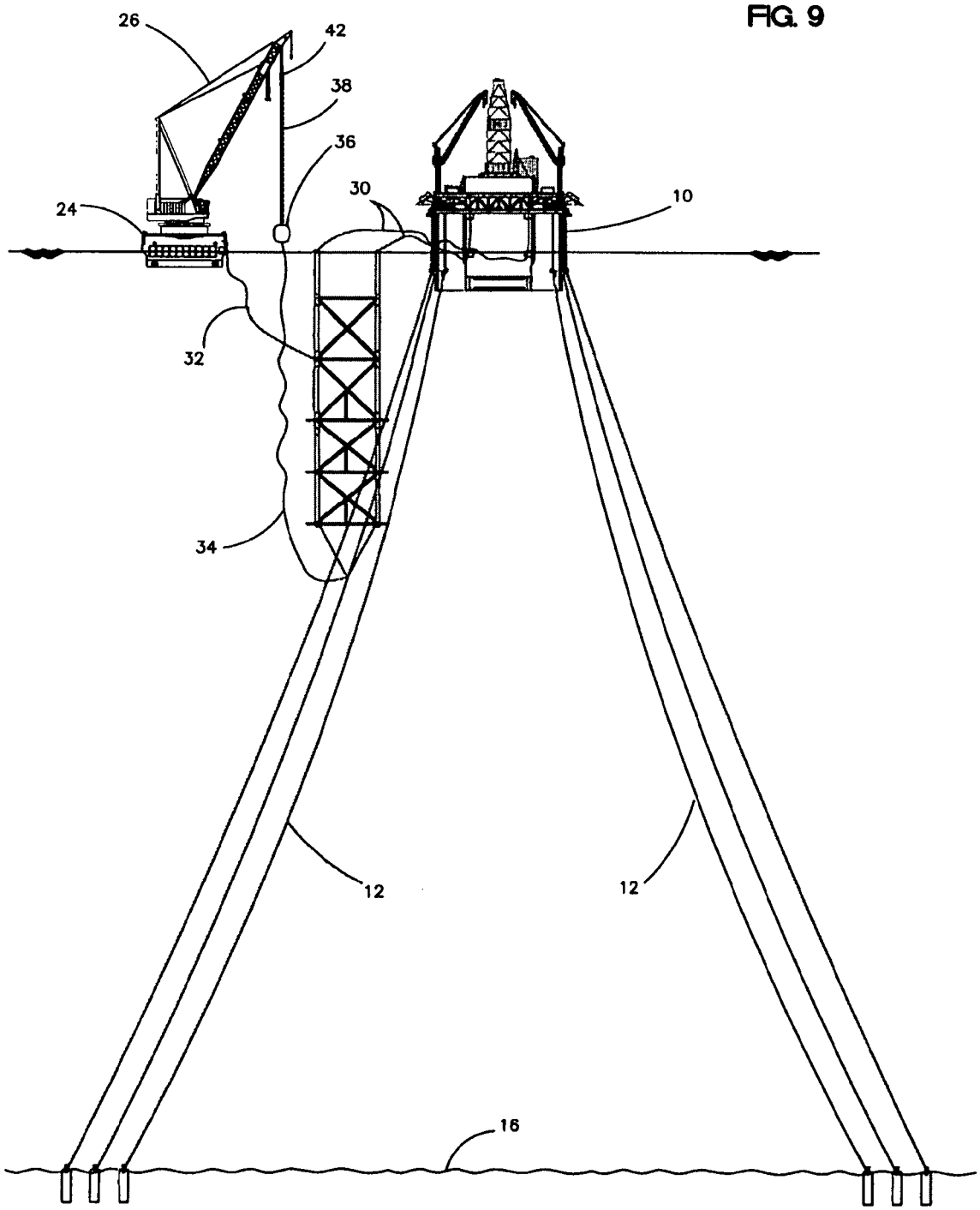
FIG. 9-13 illustrate an alternate embodiment of the invention.

As seen in FIGS. 5 and 6, the truss structure 18 is lowered by the crane 26 to a predetermined depth below the water surface that allows transfer of the truss structure weight from the crane support lines 28 to the haul-in lines 30. The truss structure 18 is not allowed to contact the sea floor 16. The truss structure 18 is then aligned with the buoyant hull 10 as seen in FIG.7. The crane support lines 28 are disconnected from the truss structure 18 and the haul-in lines 30 and winches on the buoyant hull 10 are used to pull the truss structure 18 upward and into engagement with the buoyant hull 10 as seen in FIG. 8.

The truss structure 18 is then rigidly attached to the buoyant hull 10 by means known in the industry such as grouting and welding. The haul-in lines 30 are then disconnected from the truss structure 18. The draft of the completed buoyant hull 10 and truss structure 18 may then be adjusted as required for operating in the prevailing conditions.

FIG. 9-13 illustrate an alternate embodiment of the invention. The buoyant hull 10 is moored in position at the installation site in the same manner and the truss structure 18 is transported and placed in the water near the buoyant hull 10 in the same manner. Haul-in lines 30 are attached to the upper end of the truss structure 18 in the same manner.

Ballast control lines 32 are attached between the work vessel 24 and the truss structure 18. This allows an operator on the work vessel to adjust the buoyancy of the truss structure 18 by controlling the amount of water and air in the legs of the truss structure 18.

Weight transfer rigging 34 is attached to the lower end of the truss structure 18. The opposite end of the weight transfer rigging 34 is attached to a clump weight 36 which is attached to a weighted line 38, such as chain. Weighted line 38 is attached to the crane line 40 by an auxiliary block 42. The crane line 40 is supported by the crane 26 on work vessel 24.

Figure 10:
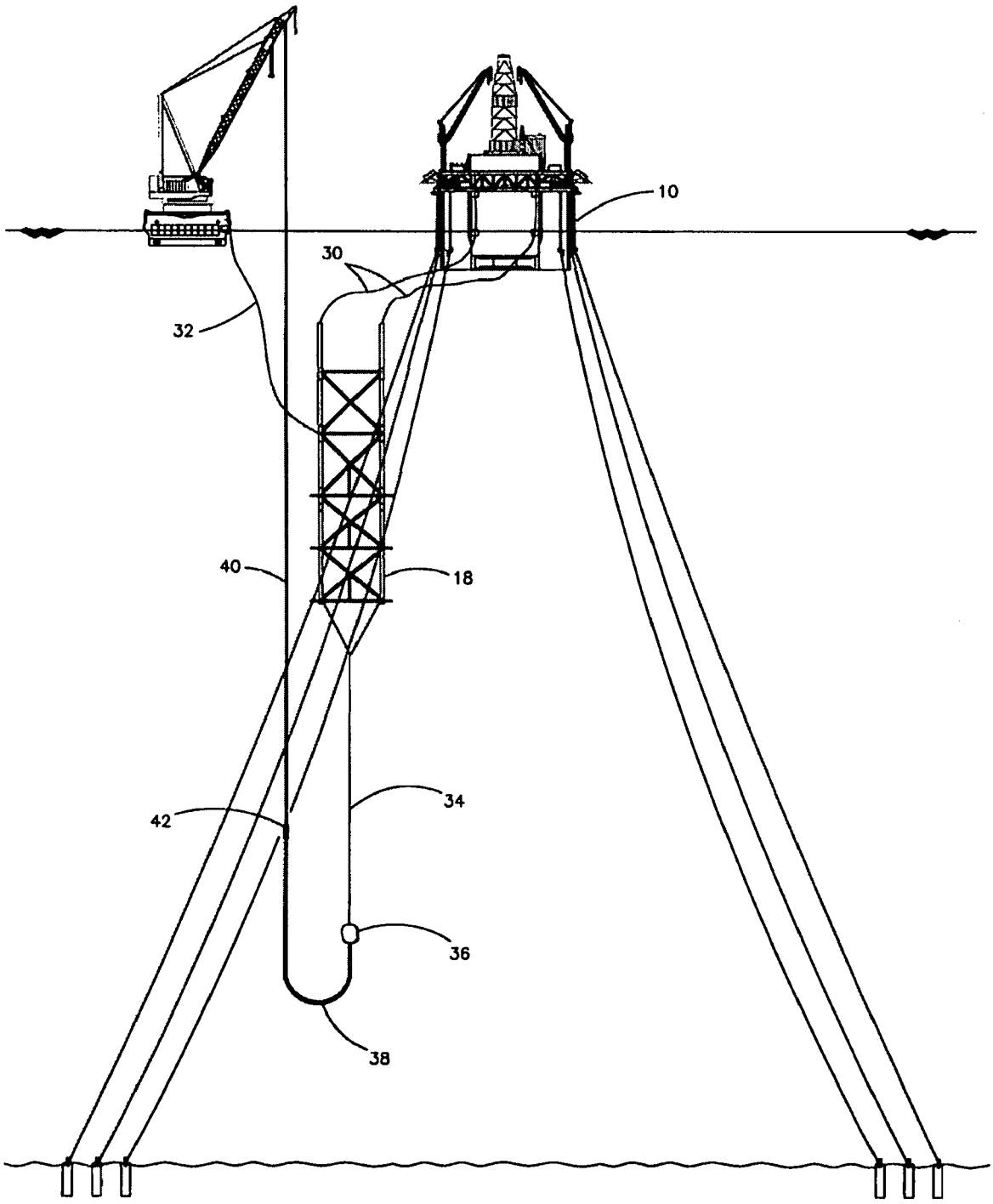
Figure 11:
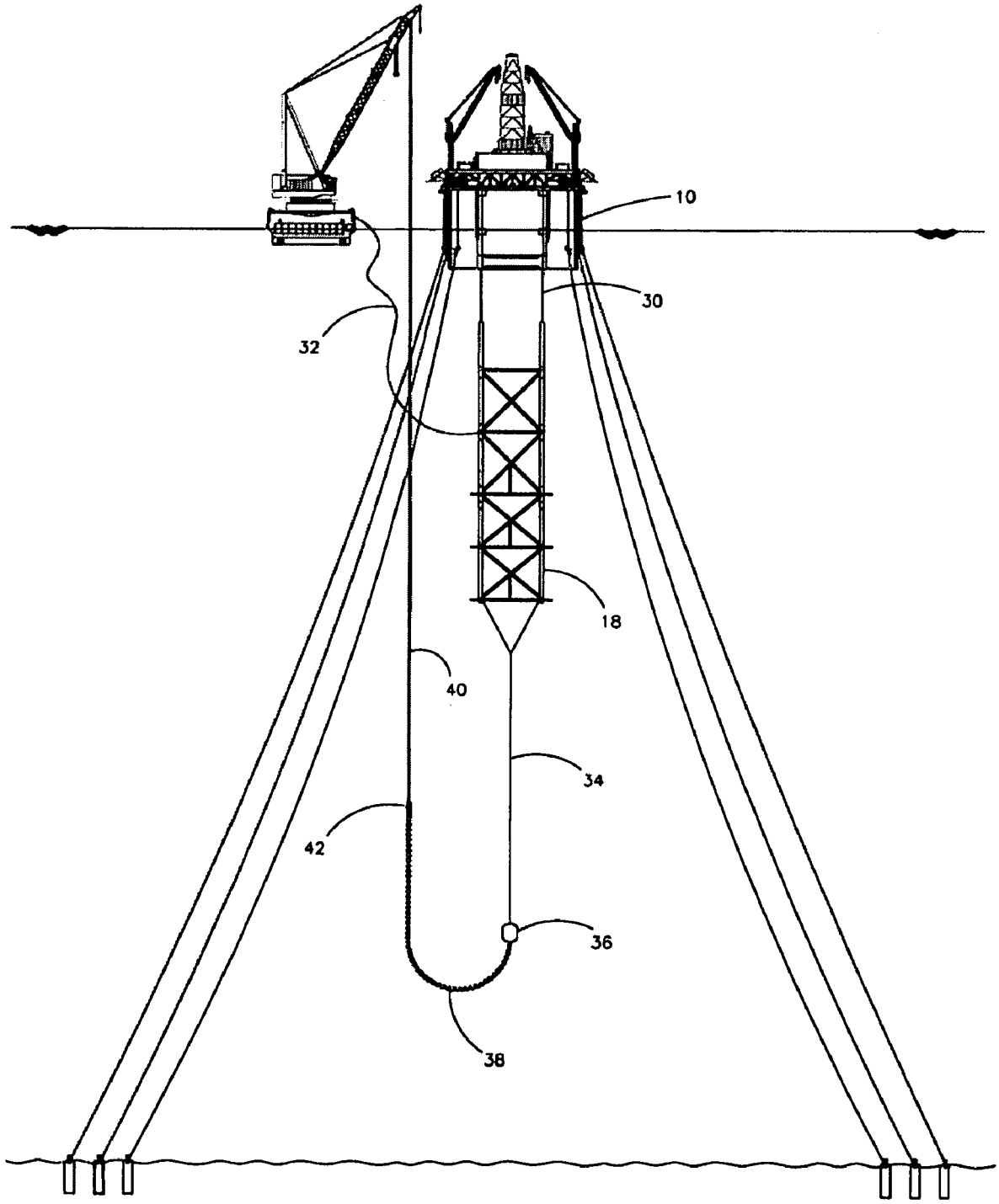

As seen in FIG. 10, the clump weight 36 and weighted line 38 are lowered below the truss structure 18. The buoyancy of the truss structure 18 is reduced to allow the clump weight 36 and weighted line to cause a controlled descent of the truss structure 18 to a predetermined depth below the water surface that prevents contact of the truss structure 18 with the sea floor 16. The truss structure is allowed to float under and in alignment with the buoyant hull 10. The ballast control lines 34, clump weight 36, and weighted line 38 are used to control the movement and depth of the truss structure 18 until the haul-in lines 30 take up slack and are placed in tension with the truss structure 18 as seen in FIG. 11.

Figure 12:
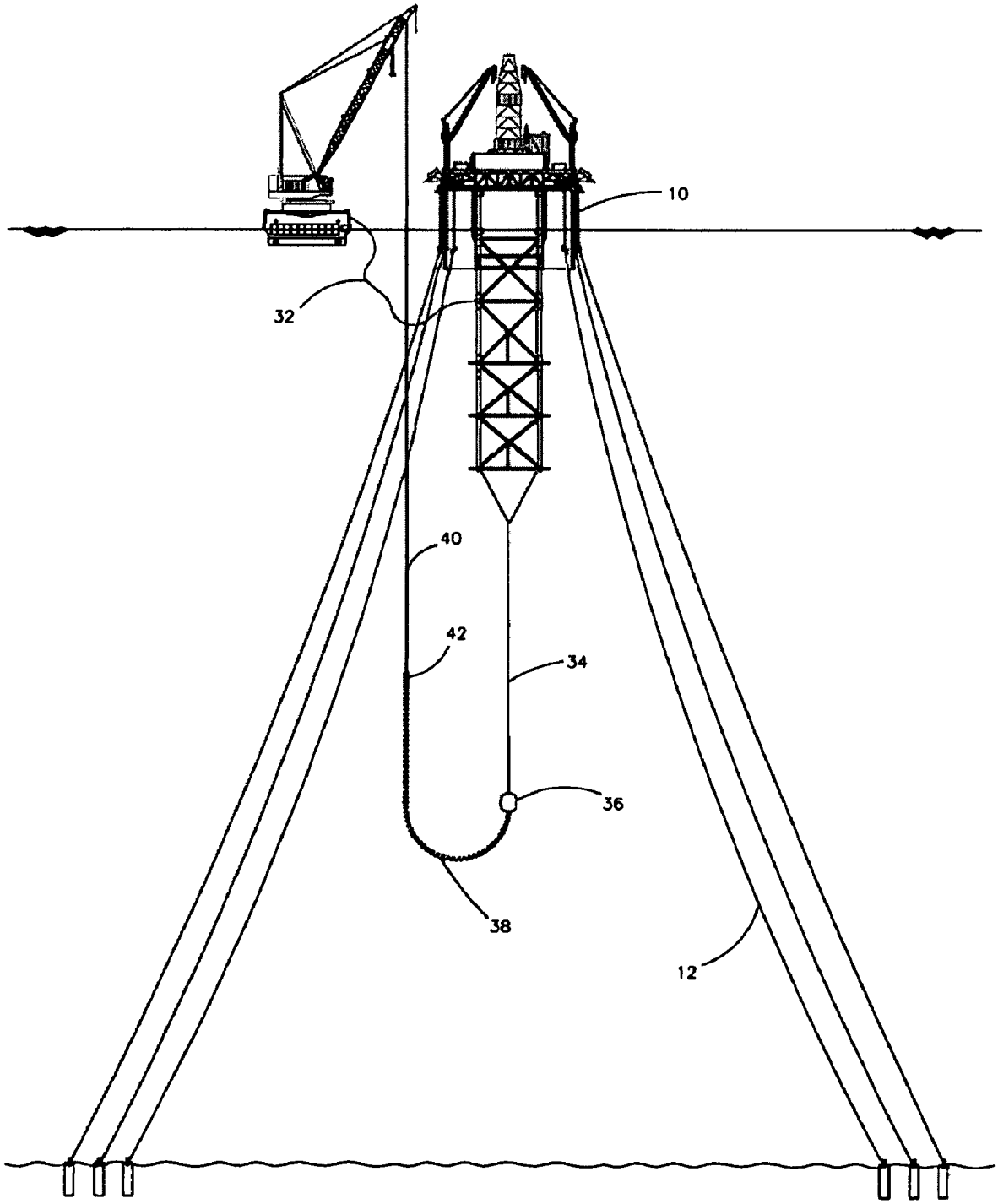
Figure 13:
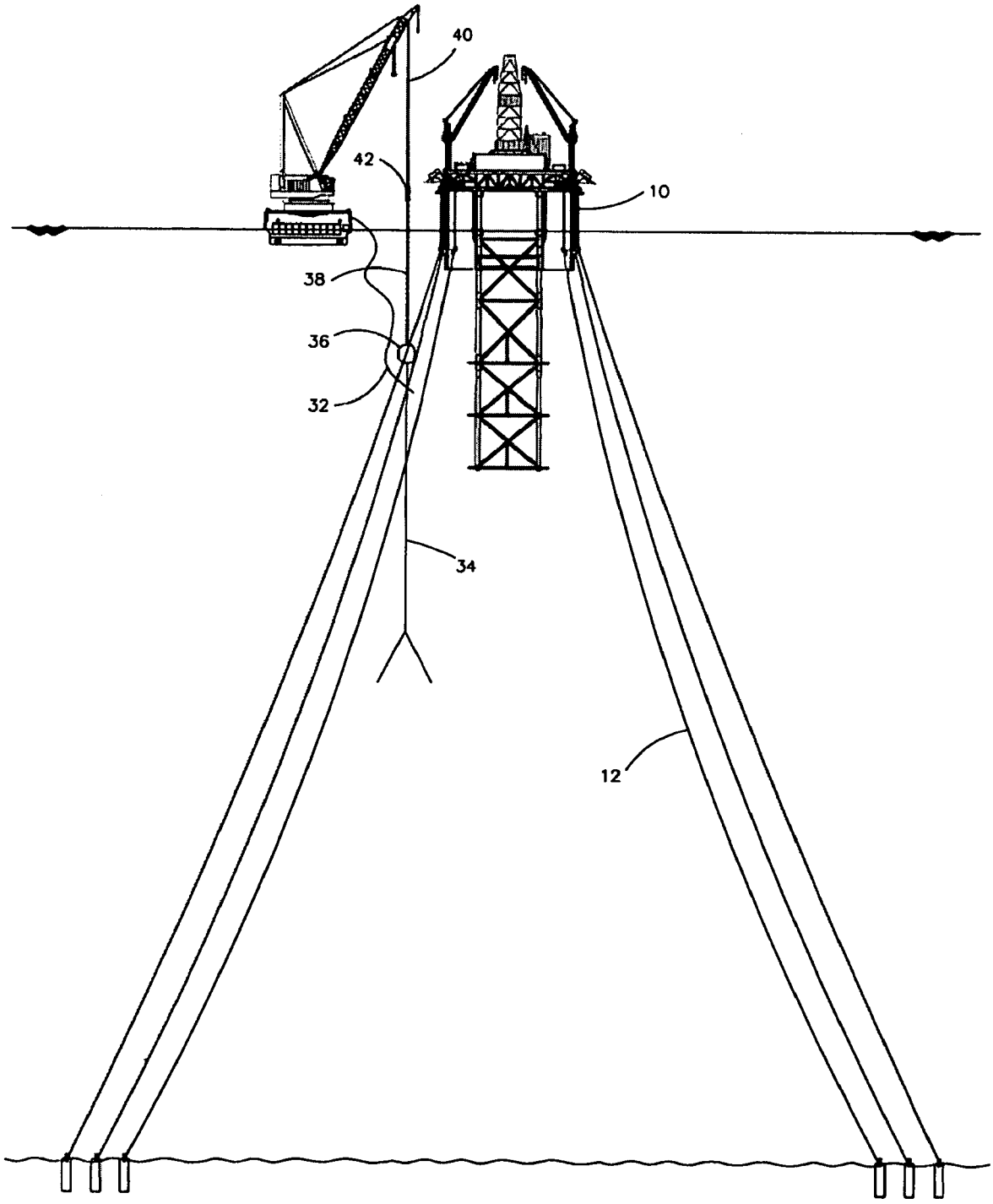

As seen in FIG. 12, the haul-in lines 30 and winches on the buoyant hull 10 are used to pull the truss structure upward into engagement with the buoyant hull 10. The truss structure 18 is then rigidly attached to the buoyant hull 10 as mentioned above in a manner known in the industry such as by grouting and welding. The ballast control lines 32 and weight transfer rigging 34 are then disconnected from the truss structure 18. The draft of the completed structure of the buoyant hull 10 and truss structure may then be adjusted as required for operating in the prevailing conditions.

In both methods of installation, the truss structure 18 is allowed to move toward and under the buoyant hull 10 by tension from the haul-in lines 30 due to the weight transferred.

While the basic steps of the inventive method are described above, it will be understood by those familiar with the installation of offshore floating structures that weight bearing line preparations and ROV surveys to confirm alignment of the structures are required at various stages of the process.

The invention provides the following advantages.

The geotechnical/geological risks come only from the installation/platform site. Weather risks also only come from mobilizing to and at the installation/platform site. Since both weather and geotechnical/geological risks are all only at the installation/platform site, this should tend to reduce towing distances and exposure times.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

What is claimed is:

1. A method of attaching a truss structure to a buoyant hull section while at an offshore operating site of the combined structures, comprising the steps:

a. mooring the buoyant hull in position;

b. floating the truss structure adjacent the buoyant hull;

c. attaching crane support lines from a work vessel and haul-in lines from the buoyant hull to the upper end of the truss structure;

d. lowering the truss structure below a water surface to a predetermined depth that transfers the truss structure weight from the crane support lines to the haul-in lines while preventing the truss structure from contacting a water surface;

e. moving the truss structure into position under and aligned with the buoyant hull;

f. disconnecting the crane support lines from the truss structure; and g. moving the truss structure upward into engagement with the buoyant hull by use of the haul-in lines.

2. The method of claim 1, further comprising the step of rigidly attaching the truss structure to the buoyant hull.

3. A method of attaching a truss structure to a buoyant hull section while at an offshore operating site of the combined structures, comprising the steps:

a. mooring the buoyant hull in position;

b. floating the truss structure adjacent the buoyant hull;

c. attaching ballast control lines from a work vessel to the truss structure;

d. attaching weight transfer rigging from a work vessel to a lower end of the truss structure and haul-in lines from the buoyant hull to an upper end of the truss structure;

e. lowering the truss structure below a water surface;

f. moving the truss structure into position under and aligned with the buoyant hull; and g. moving the truss structure upward into engagement with the buoyant hull.

4. The method of claim 3, wherein the weight transfer rigging includes a clump weight and weighted lines.

5. The method of claim 3, wherein step g of moving the truss structure upward into engagement with the buoyant hull includes the use of the haul-in lines and the ballast control lines.

6. The method of claim 3, further comprising the step of rigidly attaching the truss structure to the buoyant hull.

7. A method of attaching a truss structure to a buoyant hull section while at an offshore operating site of the combined structures, comprising the steps:

a. mooring the buoyant hull in position;

b. floating the truss structure adjacent the buoyant hull;

c. attaching ballast control lines from a work vessel to the truss structure;

d. attaching weight transfer rigging, a clump weight, and a weighted line from a work vessel to a lower end of the truss structure and haul-in lines from the buoyant hull to an upper end of the truss structure;

e. lowering the truss structure below a water surface;

f. moving the truss structure into position under and aligned with the buoyant hull; and g. moving the truss structure upward into engagement with the buoyant hull using the haul-in lines and the ballast control lines.

8. The method of claim 7, further comprising the step of rigidly attaching the truss structure to the buoyant hull.

* * * * *

UNITED STATES PATENT AND TRADEMARK OFFICE

CERTIFICATE OF CORRECTION

PATENT NO. : 7,849,810 B2
APPLICATION NO. : 12/429229
DATED : December 14, 2010
INVENTOR(S) : Bobby P. Cline et al.

It is certified that error appears in the above-identified patent and that said Letters Patent is hereby corrected as shown below:

Column 4, Line 59, change “water surface” to “sea floor”.

Signed and Sealed this
First Day of February, 2011

David J. Kappos

David J. Kappos
*Director of the United States Patent and Trademark Office*